US010777908B2

(12) United States Patent
Choon et al.

(10) Patent No.: US 10,777,908 B2
(45) Date of Patent: Sep. 15, 2020

(54) MILLIMETER WAVE ARRAY ANTENNA AND MOBILE TERMINAL

(71) Applicant: AAC Technologies Pte. Ltd., Singapore (SG)

(72) Inventors: Tan Yew Choon, Singapore (SG); Ng Guan Hong, Singapore (SG); Tay Yew Siow, Singapore (SG)

(73) Assignee: AAC Technologies Pte. Ltd., Singapore (SG)

( * ) Notice: Subject to any disclaimer, the term of this patent is extended or adjusted under 35 U.S.C. 154(b) by 24 days.

(21) Appl. No.: 16/296,479

(22) Filed: Mar. 8, 2019

(65) Prior Publication Data

US 2020/0052415 A1 Feb. 13, 2020

(30) Foreign Application Priority Data

Aug. 7, 2018 (CN) ..... 2018 1 0893330

(51) Int. Cl.

| | |
|---|---|
| ***H01Q 21/06*** | (2006.01) |
| ***H01Q 1/24*** | (2006.01) |
| ***H01Q 1/48*** | (2006.01) |
| ***H01Q 13/10*** | (2006.01) |
| ***H01Q 21/22*** | (2006.01) |

(52) U.S. Cl.

CPC ..... *H01Q 21/064* (2013.01); *H01Q 1/243* (2013.01); *H01Q 1/48* (2013.01); *H01Q 13/10* (2013.01); *H01Q 21/22* (2013.01)

(58) Field of Classification Search

CPC ..... H01Q 1/243; H01Q 1/48; H01Q 13/10; H01Q 21/22; H01Q 21/064; H01Q 21/0043; H01Q 21/005

See application file for complete search history.

(56) References Cited

U.S. PATENT DOCUMENTS

2016/0134021 A1* 5/2016 Helander ..... H01Q 21/08 343/893
2017/0162950 A1* 6/2017 Little ..... H01Q 13/085
(Continued)

FOREIGN PATENT DOCUMENTS

CN 107331946 A1 11/2017

OTHER PUBLICATIONS

PCT search report dated Aug. 9, 2019 by SIPO in related PCT Patent Application No. PCT/CN2019/088993 (6.
(Continued)

*Primary Examiner* — Seokjin Kim
(74) *Attorney, Agent, or Firm* — IPro, PLLC; Na Xu

(57) ABSTRACT

The present invention provides a millimeter wave array antenna including: two metal grounding layers and a sandwich metal layer between the two metal grounding layers. The sandwich metal layer includes a top surface, a bottom surface and a plurality of antenna slots. The top surface is connected with the two metal grounding layers along a long axis direction, the bottom surface is opposite to and in parallel with the top surface, the antenna slots space the array along the long axis direction, penetrate the top surface and bottom surface and are connected with the two metal grounding layers. The metal grounding layers are provided with feed parts at positions corresponding to each antenna slot, and, each of the antenna slots, the metal grounding layers and the sandwich metal layer forms a slot antenna unit.

10 Claims, 15 Drawing Sheets

(56) References Cited

U.S. PATENT DOCUMENTS

| | | | | |
|---|---|---|---|---|
| 2017/0309992 | A1* | 10/2017 | Noori | H01Q 1/2258 |
| 2018/0097288 | A1 | 4/2018 | DiDomenico | |
| 2018/0309186 | A1* | 10/2018 | Yu | H01Q 9/16 |
| 2019/0165486 | A1* | 5/2019 | Yoshida | H01Q 3/30 |
| 2019/0229403 | A1* | 7/2019 | Yong | H01Q 1/48 |
| 2020/0052376 | A1* | 2/2020 | Zhu | H01Q 21/0075 |
| 2020/0052382 | A1* | 2/2020 | Zhu | H01Q 9/26 |
| 2020/0136268 | A1* | 4/2020 | Saeidi | H01Q 13/12 |
| 2020/0144729 | A1* | 5/2020 | Suzuki | H01Q 1/48 |

OTHER PUBLICATIONS

"Switched Folded Slot Phased Array Antenna for mm Wave 5G Mobile in Metal Bezel Design", Sung Soo Kim et. al., «2018 IEEE International Symposium on Antennas and Propagation & USNC/URSI National Radio Science Meeting ».

* cited by examiner

MILLIMETER WAVE ARRAY ANTENNA AND MOBILE TERMINAL

FIELD OF THE PRESENT DISCLOSURE

The invention relates to the technical field of manufacturing of mobile terminals, particularly to a millimeter wave array antenna and a mobile terminal.

DESCRIPTION OF RELATED ART

The antenna is a key component which radiates electromagnetic energy into and receives electromagnetic energy from the space in wireless communication equipment. The antenna transmits digital signals or analog signals which are modulated to an RF frequency into the space wireless channel, or receives digital signals or analog signals which are modulated to an RF frequency from the space.

5G is the R&D focus of the global industry. Developing 5G technology and making 5G standard are the common ideas of the industry. International Telecommunication Union (ITU) clearly specified the main application scenarios of 5G in the $22^{md}$ ITU-RWP5D conference which was held in June, 2015. ITU defines three main application scenarios: enhanced mobile broadband, large-scale machine communication and high-reliability and low-delay communication. The three main application scenarios respectively match corresponding key indexes. In the scenario of the enhanced mobile broadband, the user peak velocity is 20 Gbps, and the minimum user experience rate is 100 Mbps. To meet these strict indexes, a plurality of key technologies, including the millimeter wave technology, are used.

With the fast development of the 5G technology in the communication field, the requirement on the data transmission efficiency becomes more and more higher. To meet the demand, the frequency range of the 5G network extends to the frequency range of the millimeter wave. Thus, more and more demands that the millimeter wave antenna works at the frequency range of 20 GHz are generated.

To meet application demands, the millimeter wave antenna is often designed into an array form, i.e., a plurality of same antenna units are applied to get high gain and compensate the increase of the loss of the free space path in the frequency range of the millimeter wave. In addition, in the frequency range of the millimeter wave, if the transmitter and receiver carry out NLOS communication, the communication link is interfered and even disrupted. Thus, to maintain horizon communication, the millimeter wave antenna shall be capable of radiating to the omnidirectional space.

Thus, a novel millimeter wave array antenna is necessary to be provided to solve the problems above.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

The present disclosure hereinafter is described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Figure 1A:
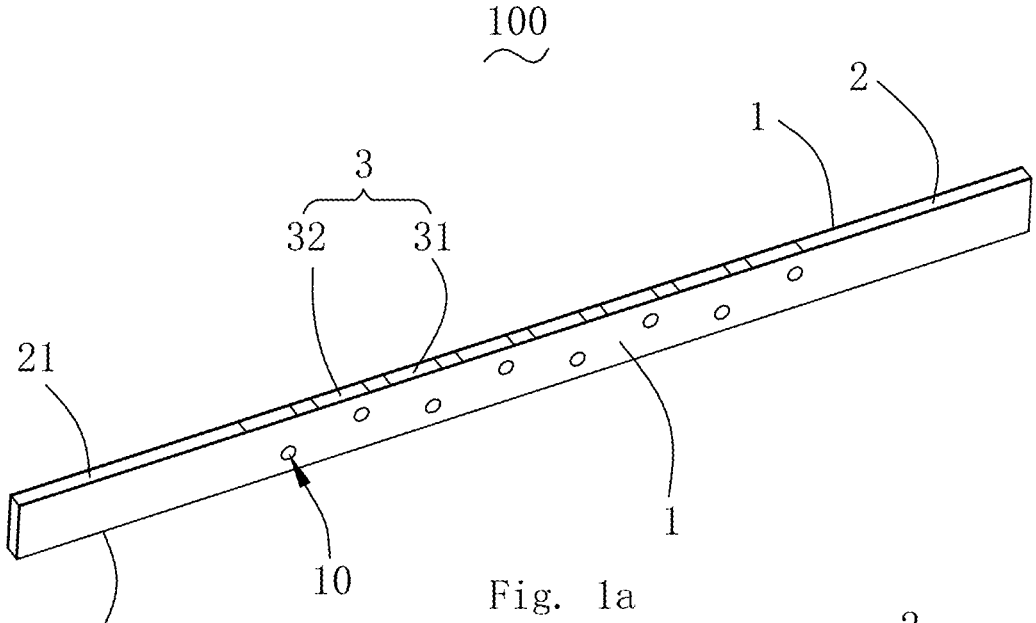
FIG. 1*a* is an isometric view of a millimeter wave array antenna in accordance with an exemplary embodiment of the invention.
Figure 1B:
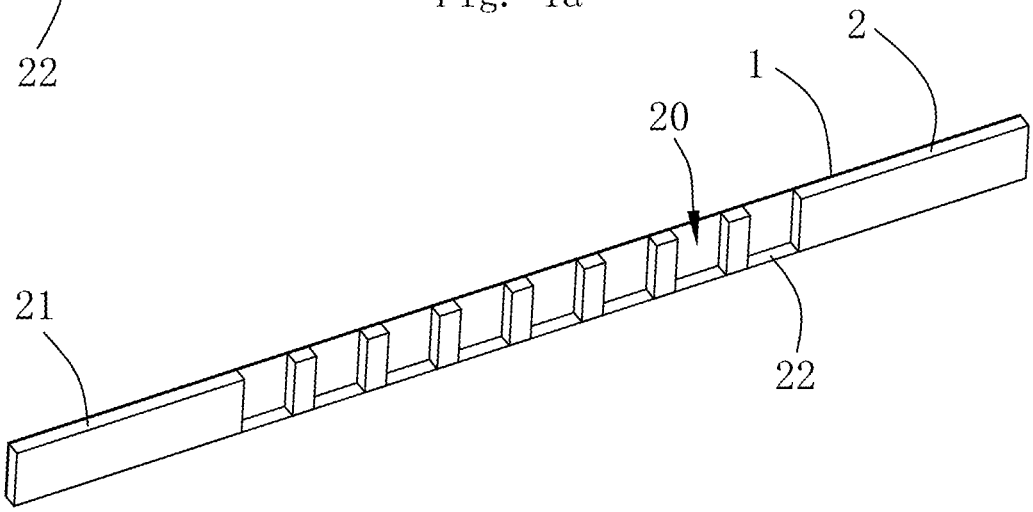
FIG. 1*b* is an illustrative view of metal grounding layers and a sandwich metal layer of the millimeter wave array antenna of the invention.

Please refer to FIGS. 1*a* and 1*b*, the embodiment of the invention provides a strip-shaped millimeter wave array antenna 100 of which the work frequency range includes 28 GHz. The strip-shaped millimeter wave array antenna 100 comprises of two metal grounding layers 1 and a sandwich metal layer 2, wherein, the two metal grounding layers 1 are arranged in parallel. The sandwich metal layer 2 is sandwiched between the two metal grounding layers 1. The sandwich metal layer 2 and the two metal grounding layers 1 are in a strip shape. The millimeter wave array antenna 100 is thinner than 1 mm. The thickness direction of the millimeter wave array antenna 100 is the direction in which one metal grounding layer 1 points to the other metal grounding layer 1. The millimeter wave array antenna 100 is a phased array antenna.

Figure 1C:
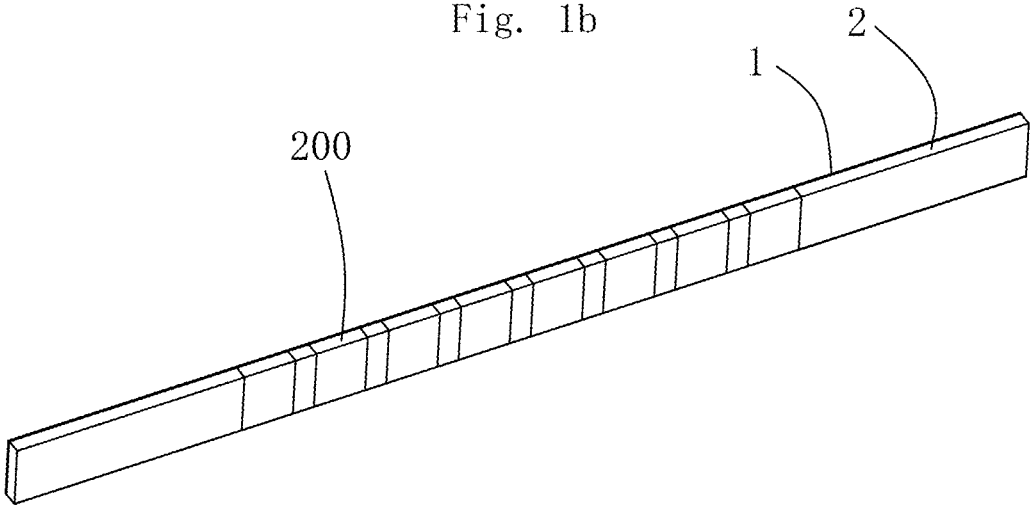
FIG. 1*c* is a front view of the structure in FIG. 1*b* with a metal grounding layer moved.

The sandwich metal layer 2 comprises of a top surface 21, a bottom surface 22, a plurality of antenna slots 20 and a sandwich dielectric layer 200, wherein, the top surface 21 is connected with the two metal grounding layers 1 along the long axis direction, the bottom surface 22 is opposite to and in parallel with the top surface 21, the antenna slots 20 space the array along the long axis direction, penetrate the top surface 21 and bottom surface 22 and are connected with the two metal grounding layers 1. Please refer to FIG. 1*c*, the sandwich dielectric layer 200 is filled in the antenna slots 20 and made from non-conductive media.

The positions of the metal grounding layers 1 corresponding to each antenna slot 20 are provided with feed parts 10 which are used to feed. Each antenna slot 20, and the metal grounding layers 1 and the sandwich metal layer 2 enclosing the slot 20 form a slot antenna unit 3.

The slot antenna unit 3 comprises of a plurality of first slot antenna units 31 and a plurality of second slot antenna units 32, which are staggered in order along the long axis direction of the sandwich metal layer 2. The gap between a first slot antenna unit 31 and a contiguous second slot antenna unit 32 is half of the wavelength of a central work frequency point.

Figure 2A:
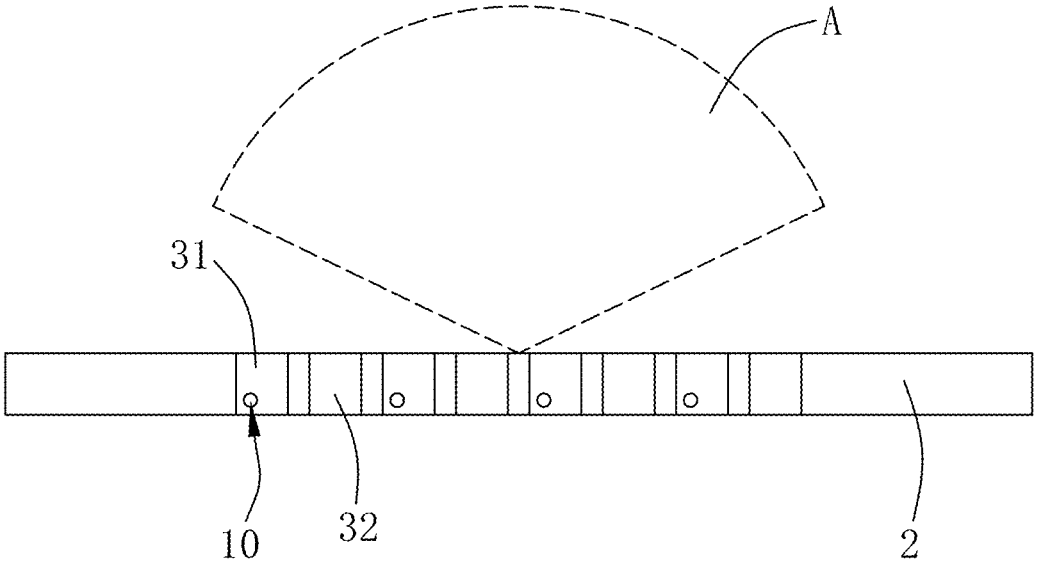
FIG. 2*a* is an illustration of a radiation of an upper area of the millimeter wave array antenna of the invention.
Figure 2B:
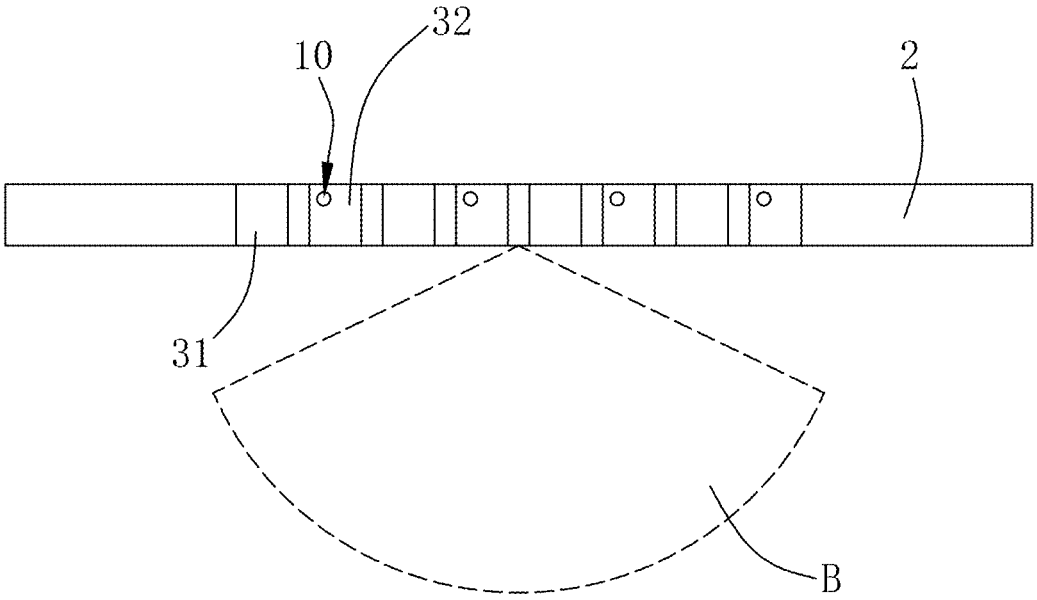
FIG. 2*b* is an illustration of a radiation of a lower area of the millimeter wave array antenna of the invention.

The feed parts 10 of the first slot antenna units 31 are arranged closely to the bottom surface 22, and the feed parts 10 of the second slot antenna units 32 are arranged closely to the top surface 21. The first slot antenna units 31 form a first millimeter wave array antenna, and the second slot antenna units 32 form a second millimeter wave array antenna. Please refer to FIGS. 2*a* and 2*b*, main beams of the first millimeter wave array antenna face the top surface 21 and accumulate on the upper area A corresponding to the top surface 21, and main beams of the second millimeter wave array antenna face the bottom surface 22 and accumulate on the lower area B corresponding to the bottom surface 22.

Figure 3A:
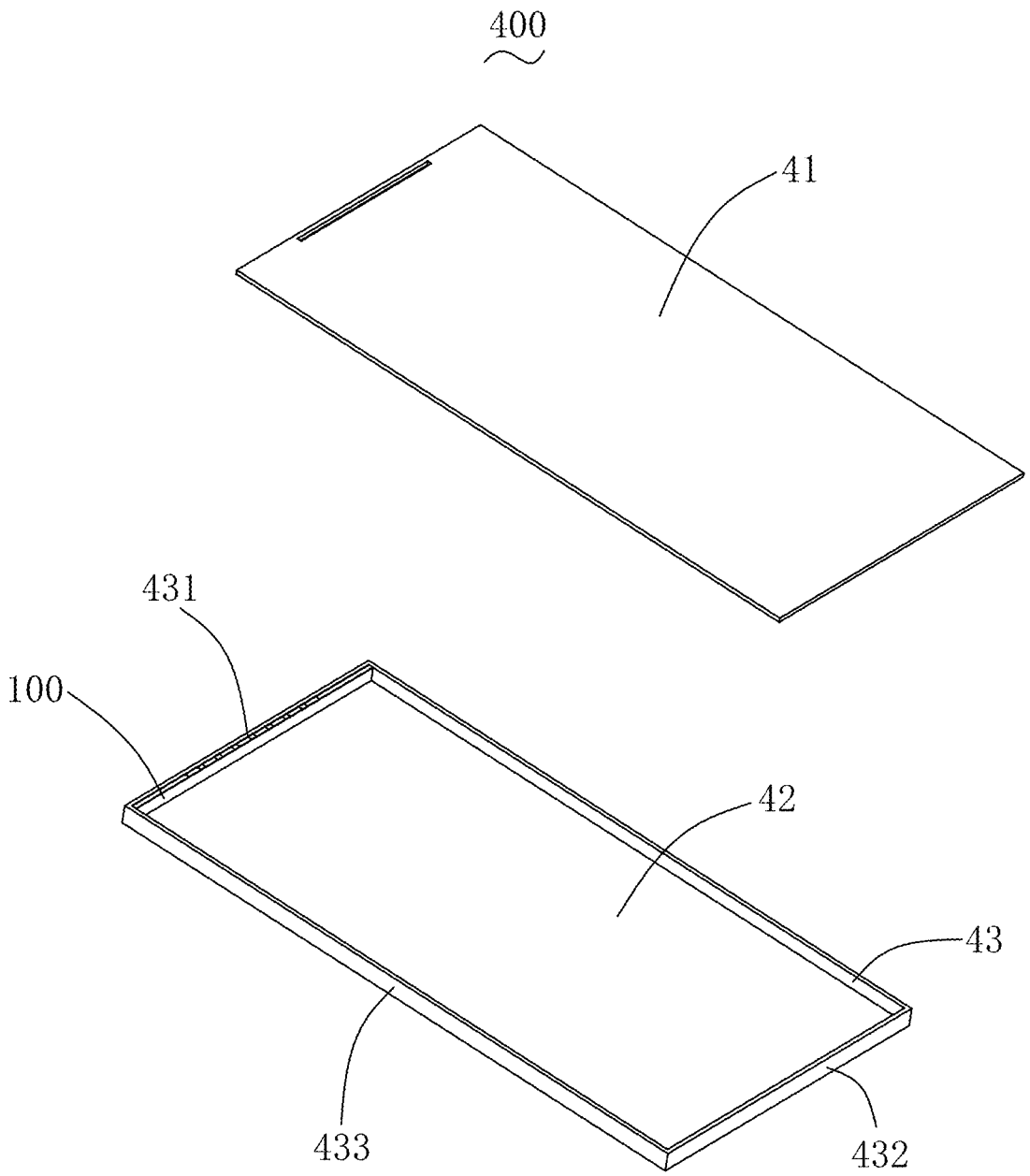
FIG. 3*a* is an isometric view of a mobile terminal, with a metal back cover removed.
Figure 3B:
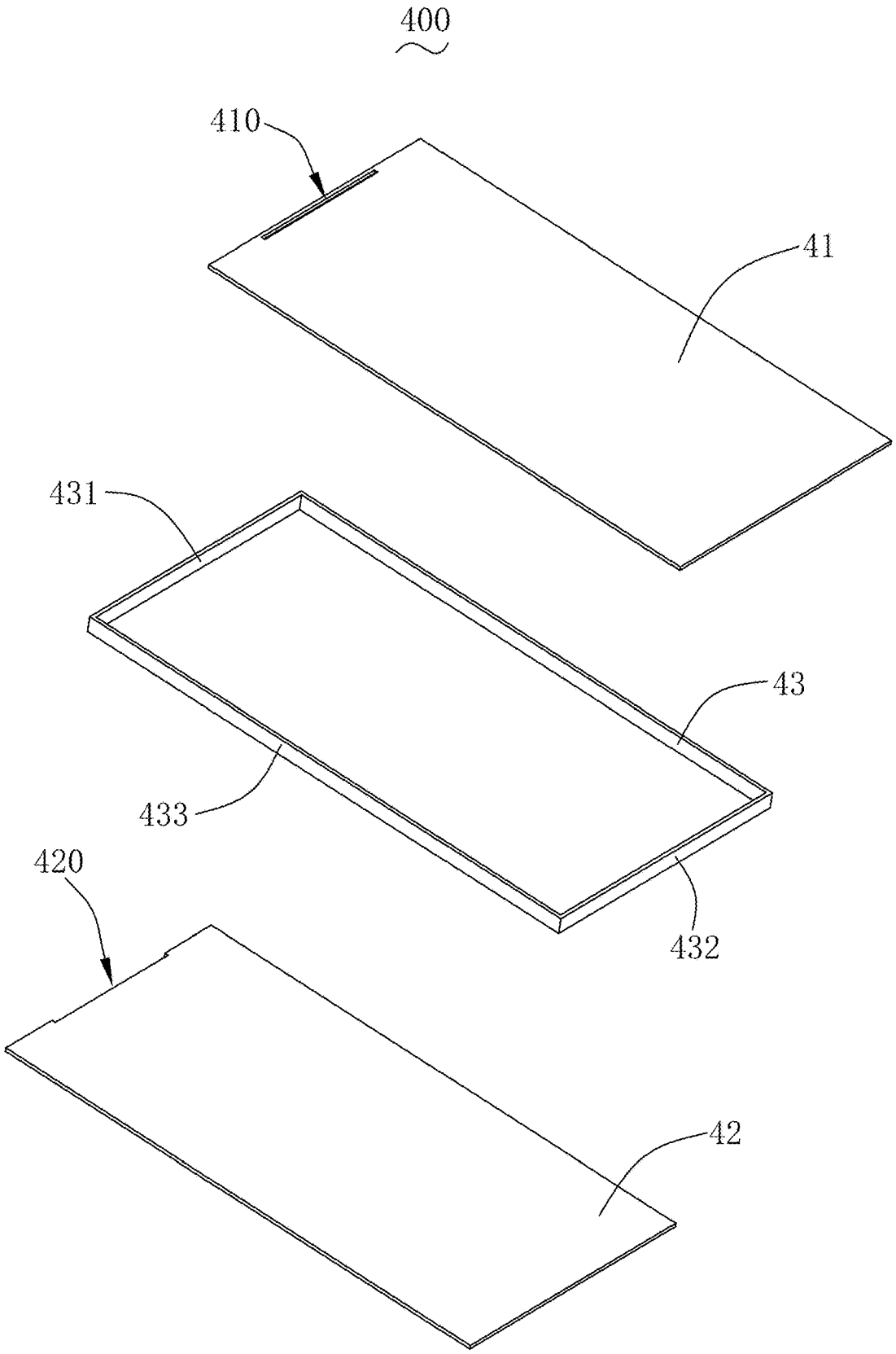
FIG. 3*b* is an isometric and exploded view of the mobile terminal.

Please refer to FIGS. 3*a* and 3*b*; the invention also provides a mobile terminal 400 which uses the millimeter wave array antenna 100. The mobile terminal 400 also comprises of a back cover 41, a framework 42 and a rectangular frame 43, wherein, the frame 43 is included between the back cover 41 and the framework 42. Of course, the mobile terminal 400 can comprise of other components, such as an LCD panel which is protected by the framework 42.

The millimeter wave array antenna 100 is arranged on the inner side surface of the frame 43, and the metal grounding layers 1 of the millimeter wave array antenna 100 are opposite to the inner side surface. The top surface of the sandwich metal layer 2 faces the back cover. The bottom surface of the sandwich metal layer faces the framework.

The frame 43 can be set as 142 mm long and 72 mm wide, i.e., the frame 43 can be used for a 5.5-inch mobile terminal or an LCD tablet computer which is 6 inches in maximum. The frame 43 comprises of a first short edge 431 at the top, a second short edge 432 which is at the bottom and spaced in parallel with the first short edge 431, and two long edges 433 which connect with the first short edge 431 and the second short edge 432. The millimeter wave array antenna 100 is arranged on the inner side surface of the first short edge 431, and the length direction of the millimeter wave array antenna 100 is consistent with the length direction of the first short edge 431. It has to explain that the sizes of the frame and the mobile terminal of the application are not limited. Reserving enough space in the mobile terminal to set the millimeter wave array antenna is the only requirement.

The back cover 41 is made of metal. The position corresponding to the millimeter wave array antenna 100 is provided with a first located groove 410. The framework 42 is made of metal. The position corresponding to the millimeter wave array antenna 100 is provided with a second located groove 420. The frame 43 is a metal frame and electrically connected with the metal grounding layers 1.

The millimeter wave array antenna 100 which is designed in the way above has high space utilization ratio and doesn't occupy the horizontal spaces of the back cover 41 and the frame 42. In addition, the first located groove 410 and the second located groove 420 are also used for the millimeter wave array antenna 100 to upward or downward radiate electromagnetic waves and prevent the electromagnetic wave radiation of the millimeter wave array antenna 100 from being influenced by the electromagnetic shielding of the back cover 41 and the framework 42.

It should be noted that the back cover 41, the framework 42 and the frame 43 of the invention are not limited to be made from metal. In other embodiments, the back cover 41, the framework 42 and the frame 43 can be totally or partially made from nonmetal materials. When the back cover 41 and the framework 42 are made from nonmetal materials, the first located groove 410 and the second located groove 420 can be saved to avoid the electromagnetic wave radiation.

Refer to FIGS. 4-12 for the radiation performance of the millimeter wave array antenna 100 in the mobile terminal.

Figure 4A:
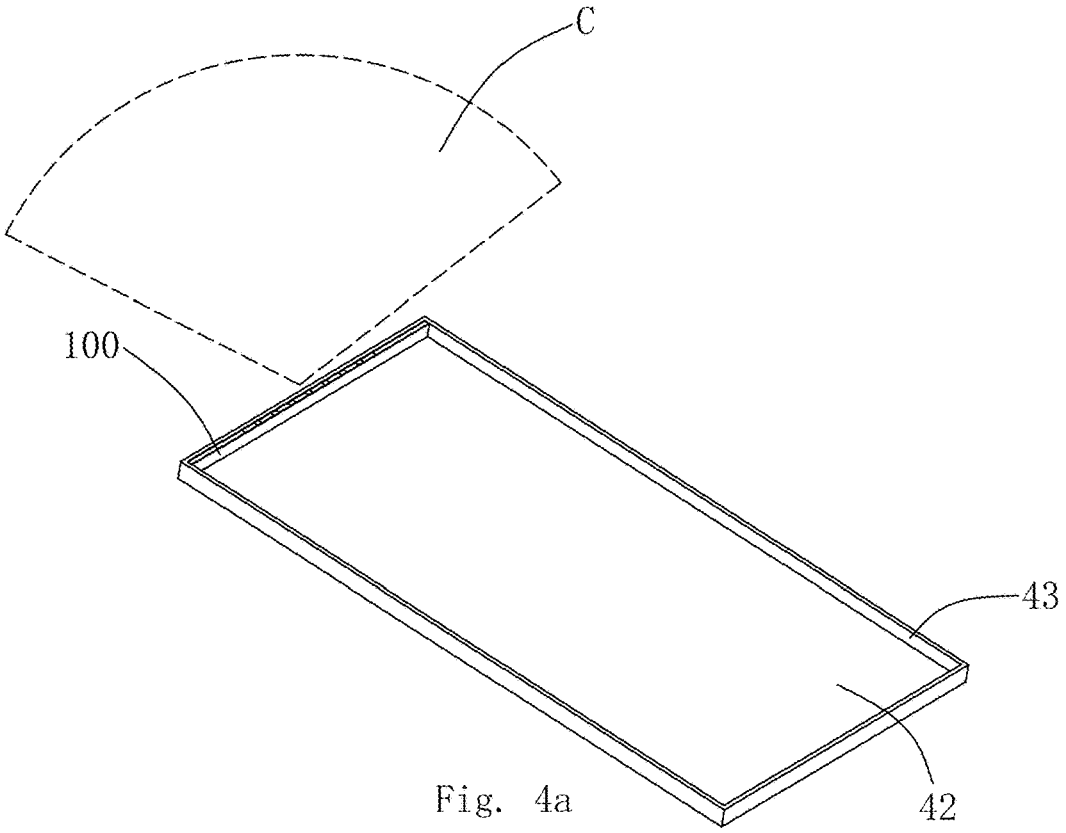
FIG. 4*a* illustrates the radiation of a top area of the mobile terminal.

Refer to FIG. 4*a* for details, the main beams which are generated by a first millimeter wave array antenna point to the direction of the back cover 41 and the main beams accumulate at a top area C. The first slot antenna units 31 work, and the feed parts 10 of the first slot antenna units 31 are in a close-up state, and the feed parts 10 of the second slot antenna units 32 are in a close-down state.

Figure 4B:
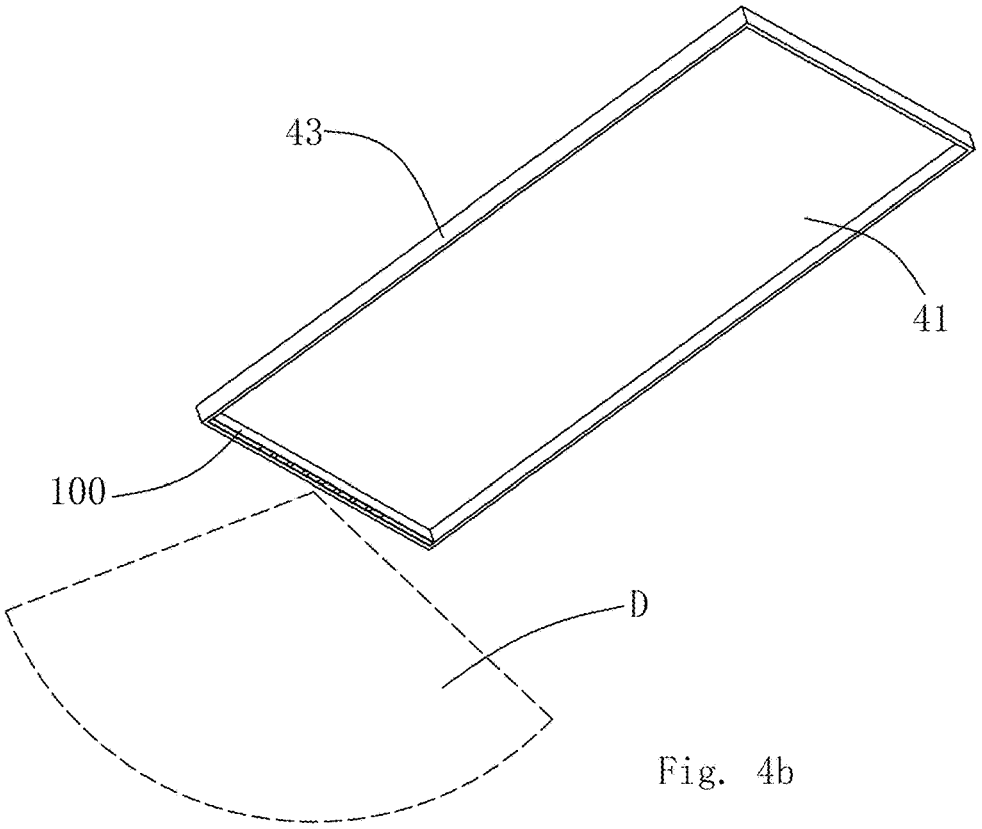
FIG. 4*b* illustrates the radiation of a bottom area of the mobile terminal.

Referring to FIG. 4*b*, the main beams which are generated by a second millimeter wave array antenna point to the direction of the framework 42 and the main beams accumulate at a bottom area D. At this time, the second slot antenna units 32 work, and the feed parts 10 of the second slot antenna units 32 are in the close-up state, and the feed parts 10 of the first slot antenna units 31 are in the close-down state.

Figure 5A:
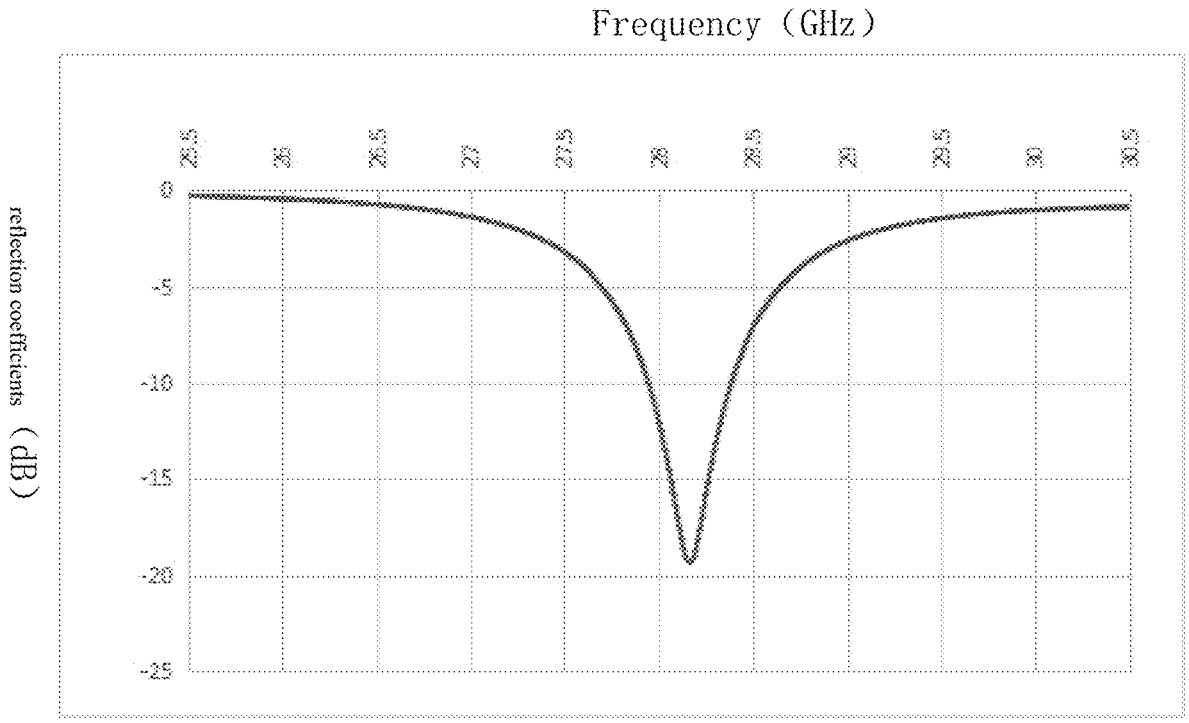
FIG. 5*a* shows the reflection coefficients of a second slot antenna units of the invention.
Figure 5B:
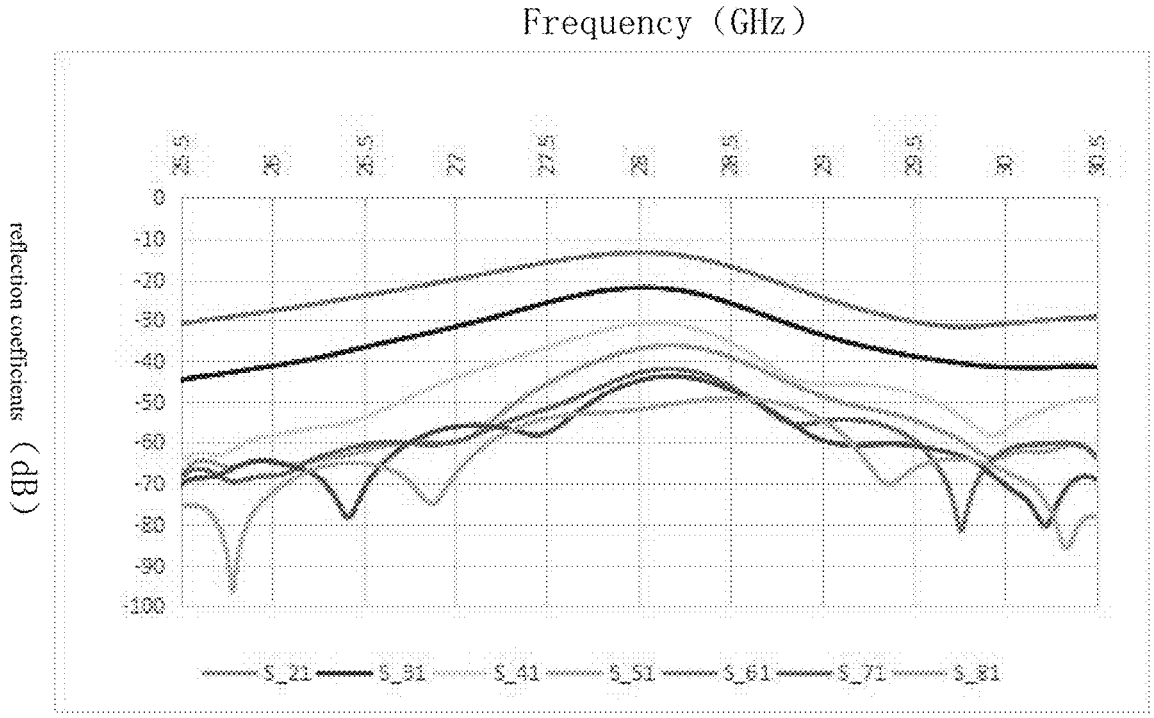
FIG. 5*b* shows the isolation degree of all slot antenna units of the invention.
Figure 5C:
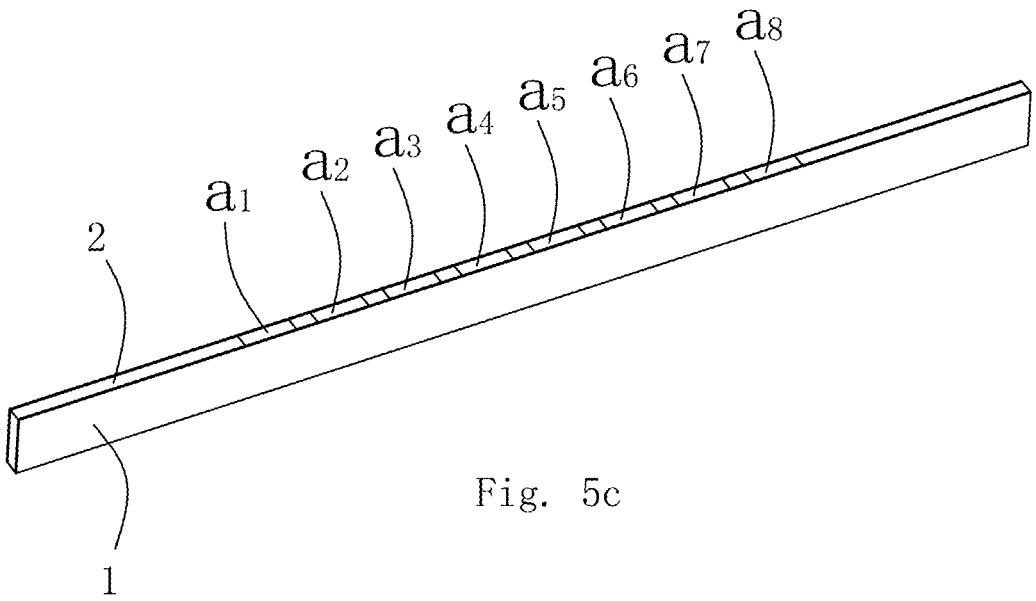
FIG. 5*c* illustrates the structure of the millimeter wave array antenna of the invention.

FIG. 5*a* shows reflection coefficients of the second slot antenna units 32, which indicate the second slot antenna units 32 work near 28 GHz. FIG. 5*b* shows the isolation degree among all slot antenna units. Combining with FIG. 5*c*, the eight slot antenna units of the antenna system 100 are respectively marked as a1, a2, a3, a4, a5, a6, a7 and a8 in order, wherein, a1, a3, a5 and a7 are the first slot antenna units 31, and a2, a4, a6, and a8 are the second slot antenna units 32. In FIG. 5*b*, take S_21 and S_71 as examples, S_21 is the isolation degree between the second slot antenna unit a 2 and the first slot antenna unit a1. Thus, near 28 GHz, the longer the distance between two slot antenna units, the better the isolation degree is.

Figure 6A:
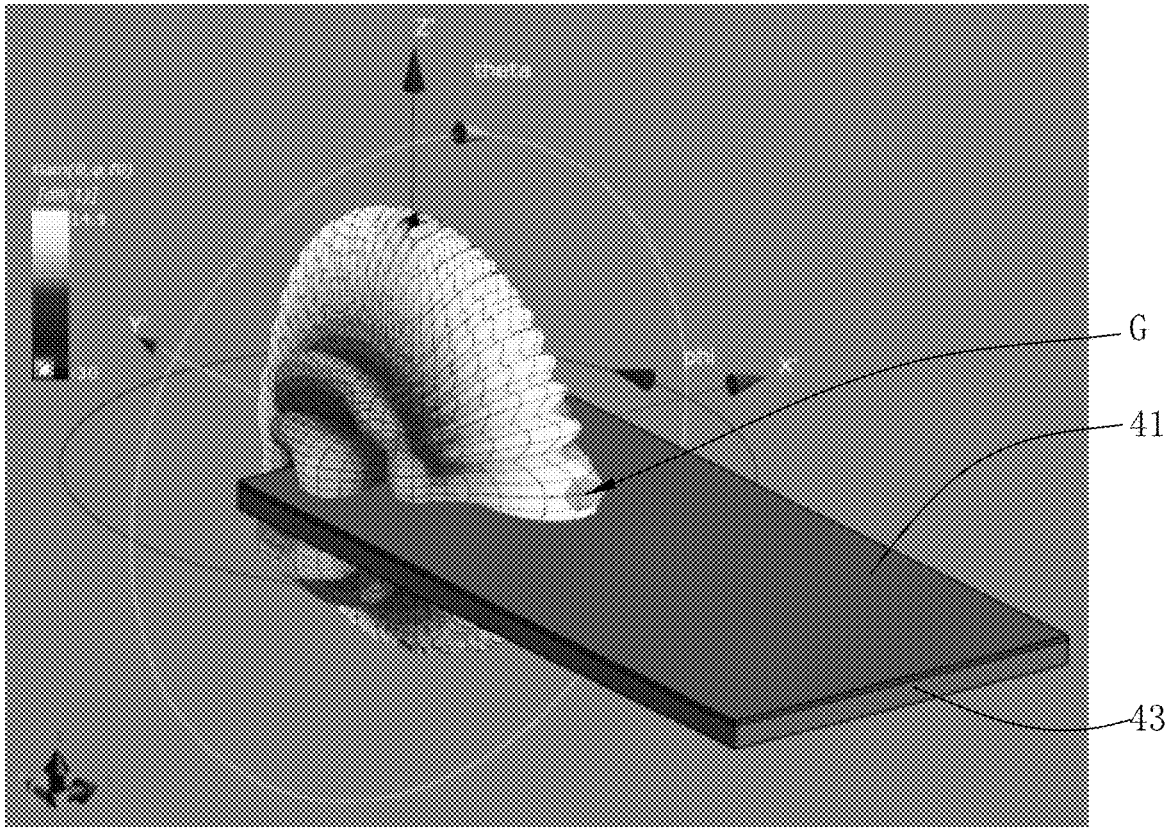
FIG. 6*a* is the radiation emulation three-dimensional visual angle view of the mobile terminal at the top area.
Figure 6B:
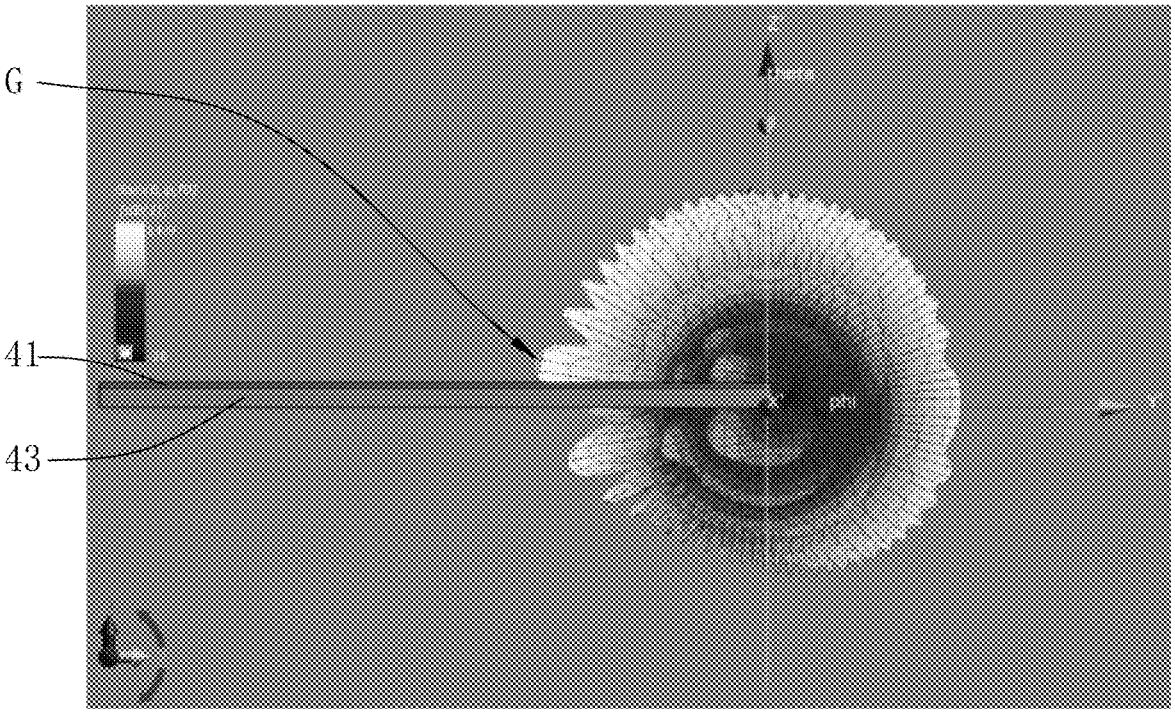
FIG. 6*b* is the radiation emulation side view of the mobile terminal at the top area.

FIGS. 6*a* and 6*b* show the antenna radiation emulation graphs of the top area C when the first millimeter wave array antenna is at 28 GHz. In the condition, the feed parts 10 of the first slot antenna units 31 are in the close-up state, and the feed parts 10 of the second slot antenna units 32 are in the close-down state. Clearly indicated by the antenna radiation emulation graphs, radiation main beams with the maximum gain G are at the top area C of the mobile terminal 400.

Figure 7A:
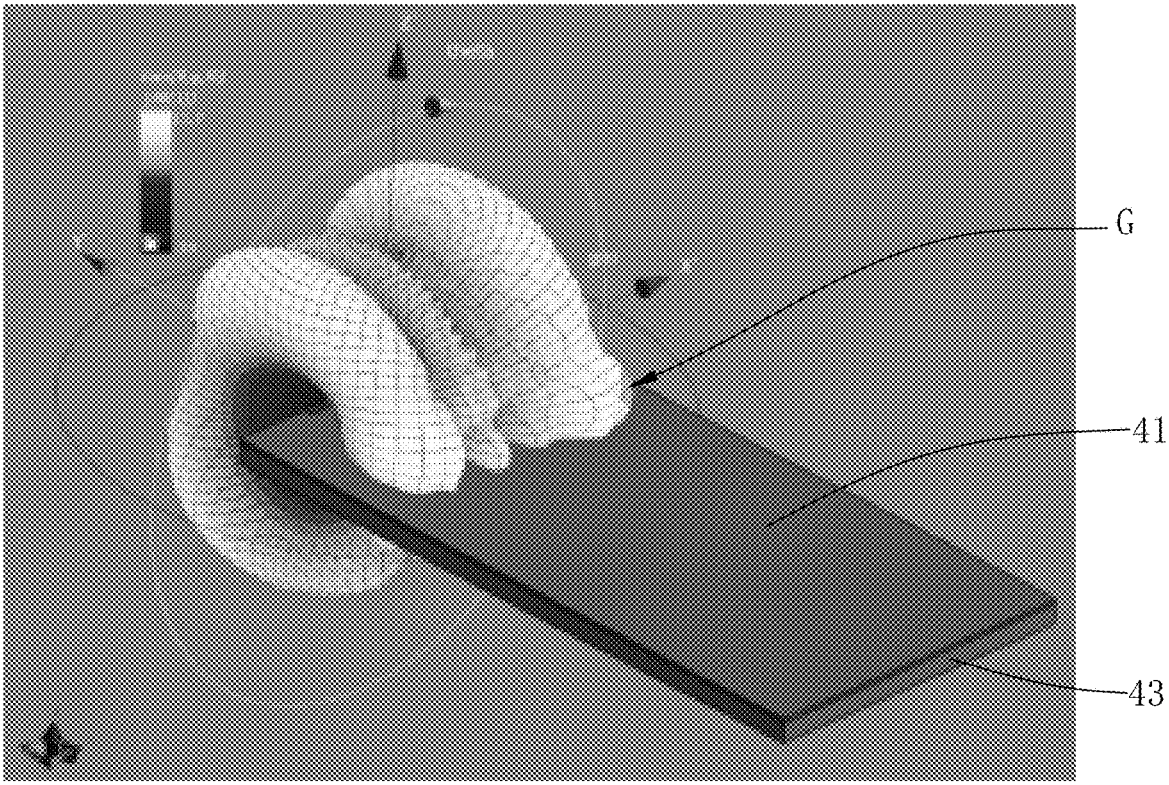
FIG. 7*a* is the radiation emulation view of the mobile terminal when the difference of first slot antenna units is −150°.
Figure 7B:
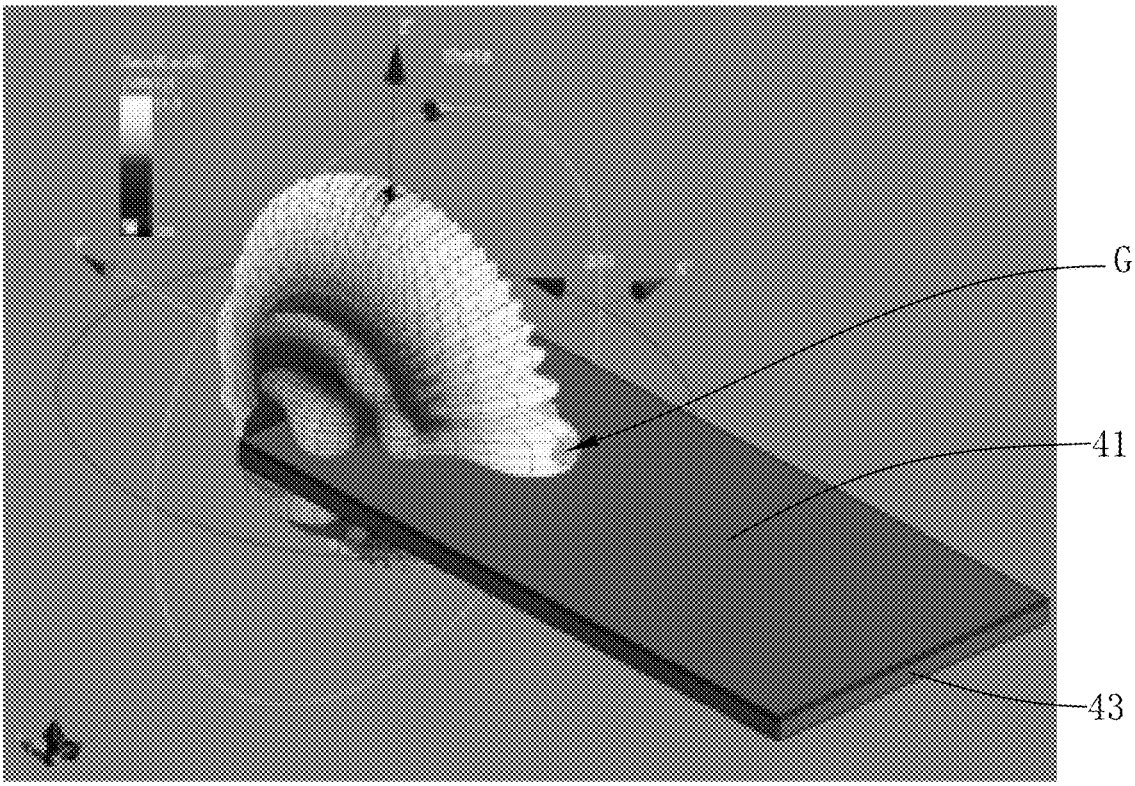
FIG. 7*b* is the radiation emulation view of the mobile terminal when the difference of first slot antenna units is 0° of phase shift.
Figure 7C:
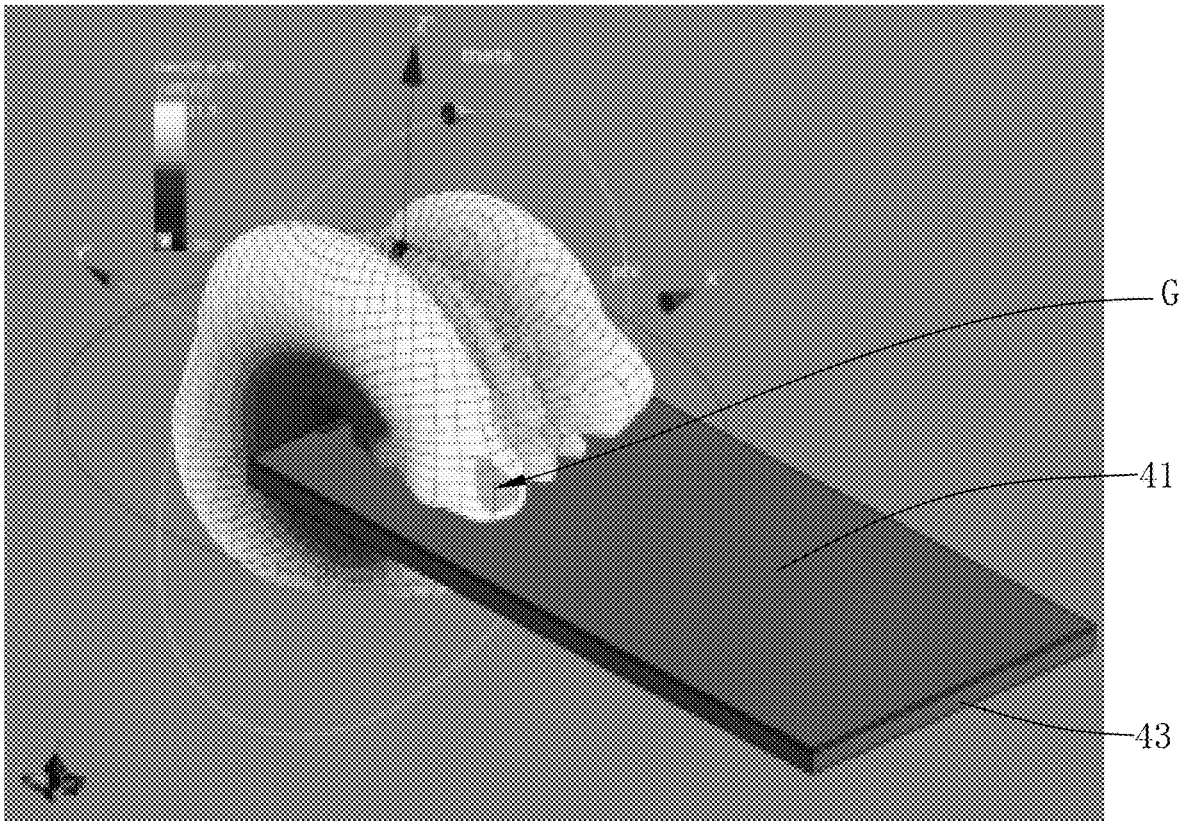
FIG. 7*c* is the radiation emulation view of the mobile terminal when the difference of first slot antenna units is 150° of phase shift.

FIGS. 7*a*-7*c* show beam pointed directions when the phase differences among the first slot antenna units 31 are respectively −150°, 0°, and 150°. Clearly indicated by the figures, with the different phase differences, the beams of the first millimeter wave array antenna are scanned in the top area. The maximum gains G when the phase differences are −150°, 0° and 150° are respectively 11.7 dB, 14.9 dB, and 11.5 dB.

Figure 8:
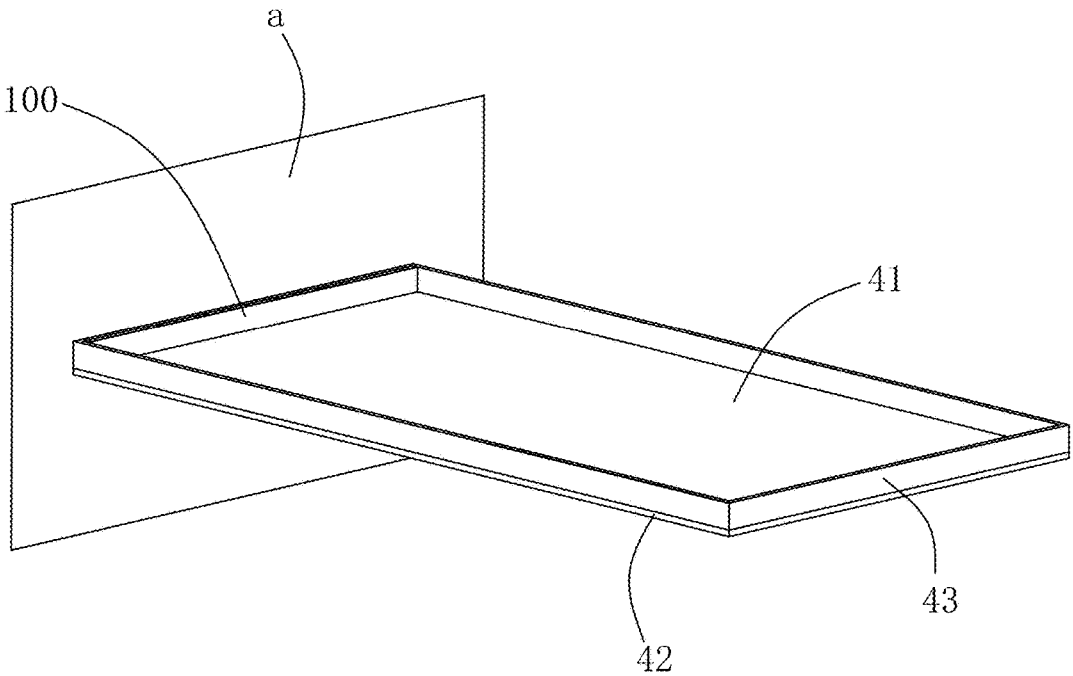
FIG. 8 is a cross-sectional view which is used for observing the gain of the millimeter wave array antenna of the mobile terminal.
Figure 9A:
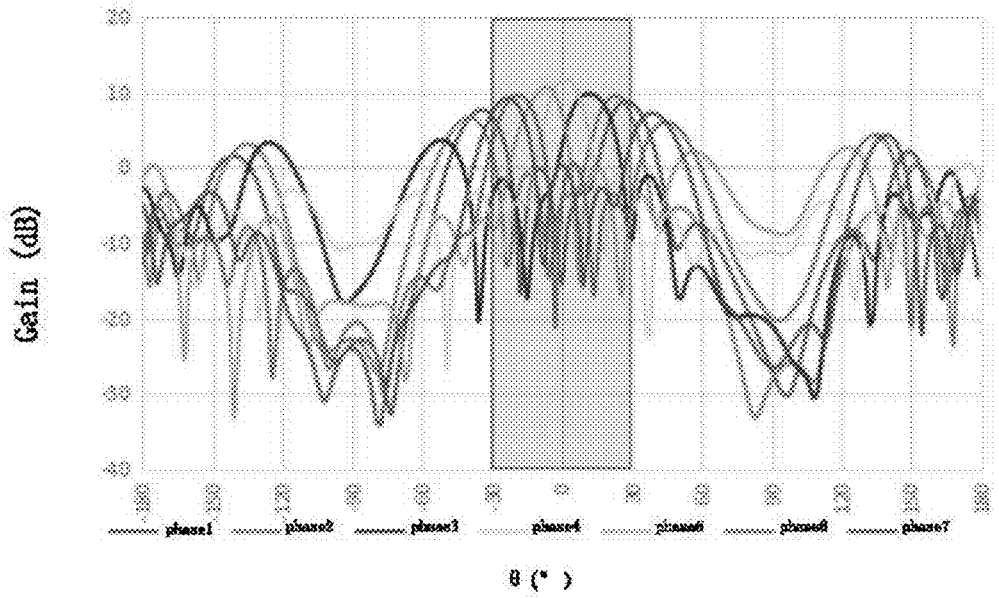
FIG. 9*a* is the emulation gain view of the top area, which is expressed in a rectangular coordinate way, of the mobile terminal.
Figure 9B:
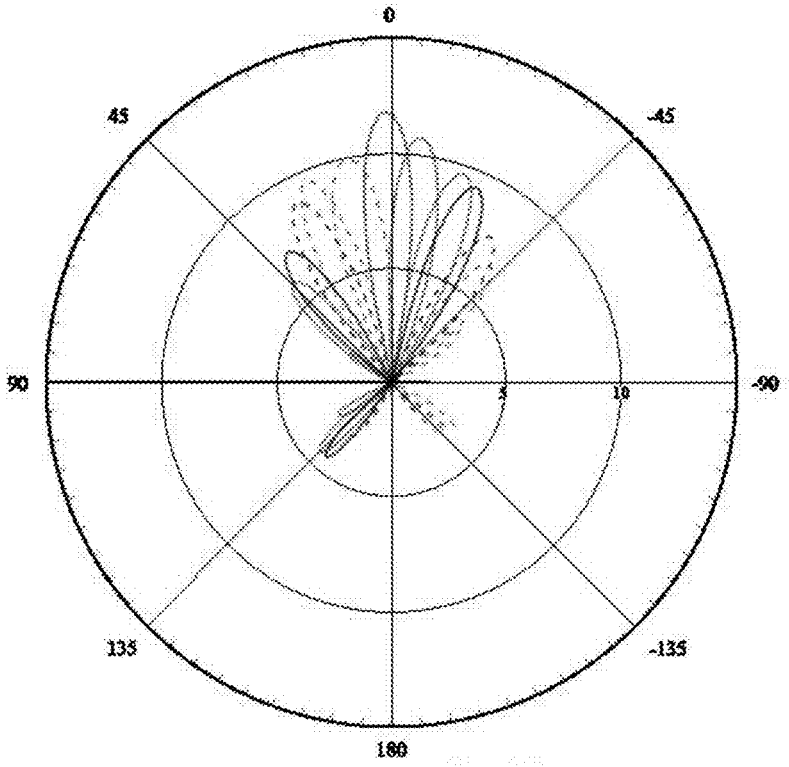
FIG. 9*b* is the emulation gain view of the top area, which is expressed in a polar coordinate way, of the mobile terminal.

FIGS. 9*a*-9*b* show the collection of the antenna gains of the first slot antenna units 31 of the millimeter wave array antenna 100 in seven different phase differences. Indicated by the antenna gain emulation, the scanning angle of the millimeter wave array antenna 100 is from −30° to 30°, and the total covering angle is 60°. The observation plane is the plane which is shown in FIG. 8.

Figure 10A:
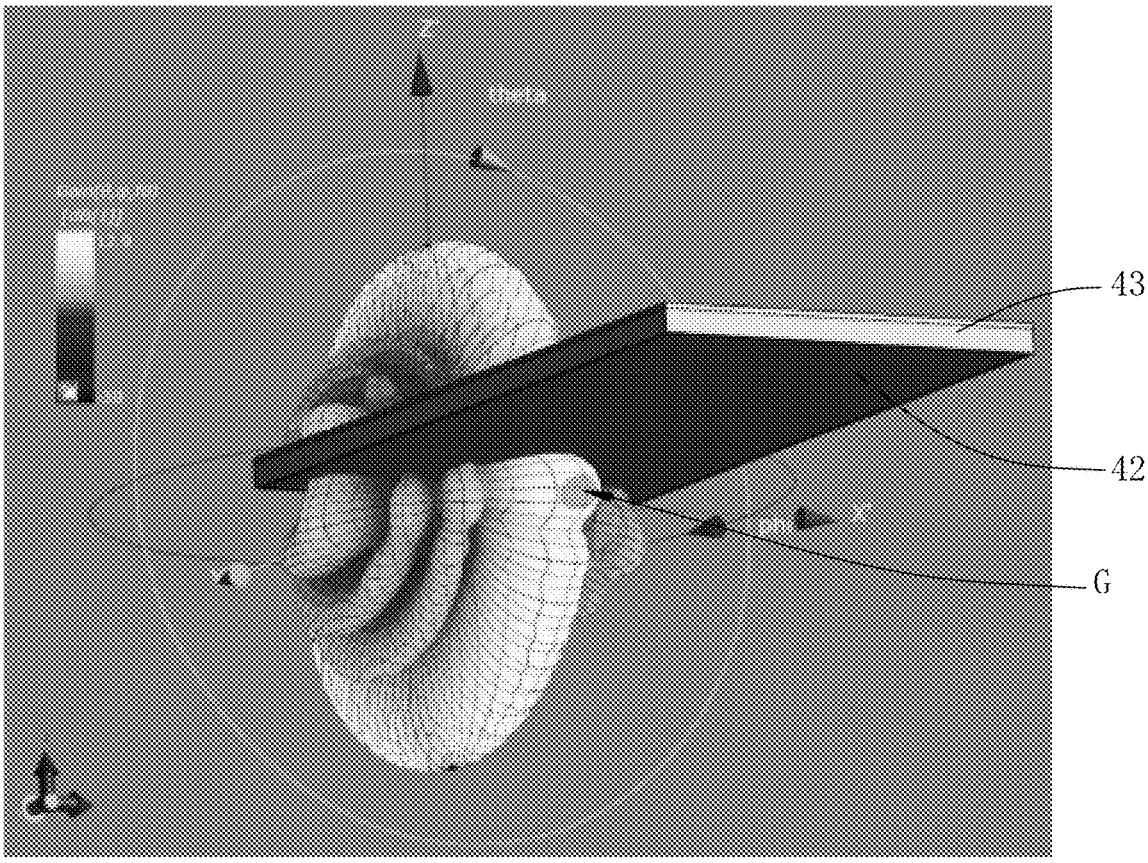
FIG. 10*a* is the radiation emulation three-dimensional visual angle view of the mobile terminal at the bottom area.
Figure 10B:
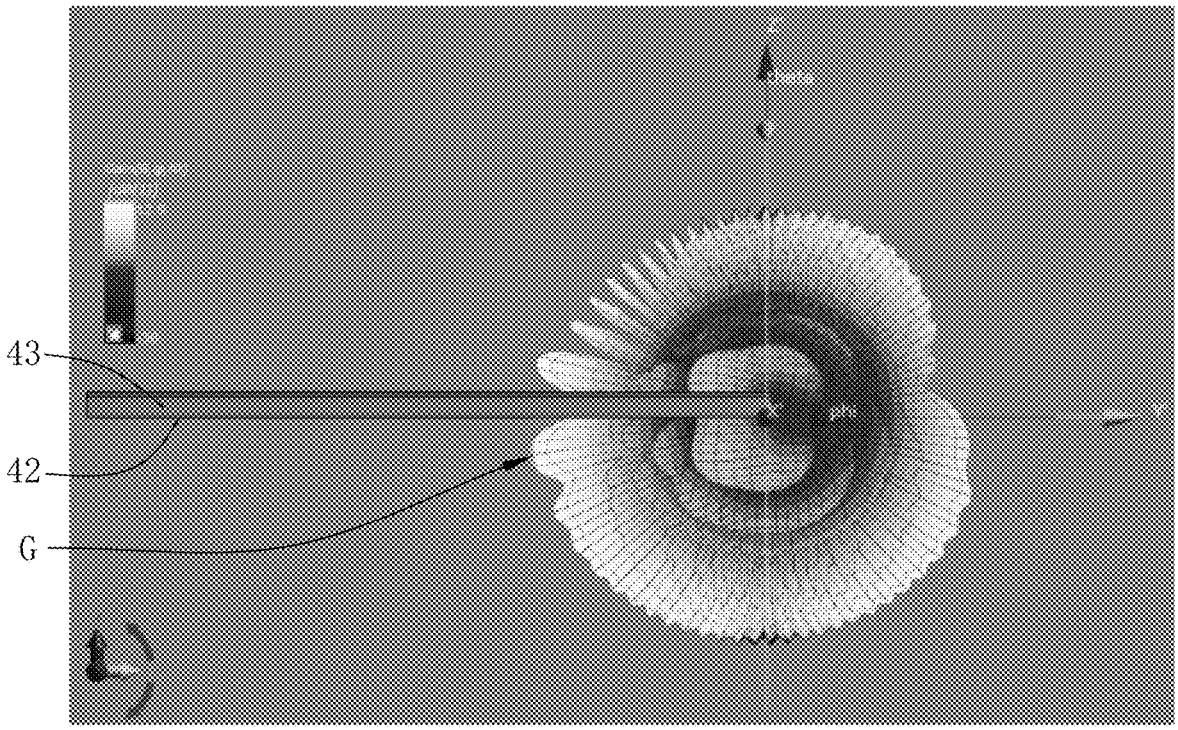
FIG. 10*b* is the radiation emulation side view of the mobile terminal at the bottom area.

FIGS. 10*a* and 10*b* show the antenna radiation emulation graphs of the bottom area D when the second millimeter wave array antenna is at 28 GHz. In the condition, the feed parts 10 of the second slot antenna units 32 are in the close-up state, and the feed parts 10 of the first slot antenna units 31 are in the close-down state. Clearly indicated by the antenna radiation emulation graphs, main radiation beams with the maximum gain G are at the bottom area D of the mobile terminal 400.

Figure 11A:
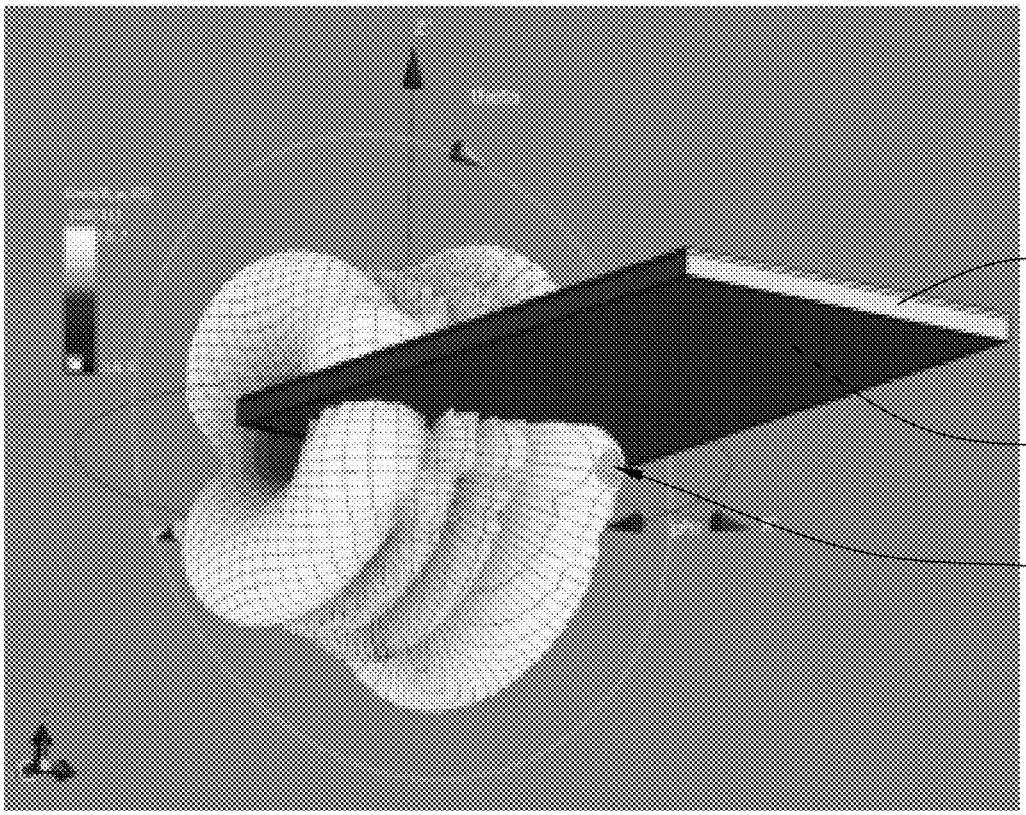
FIG. 11*a* is the radiation emulation view of the mobile terminal when the difference of second slot antenna units is −120°.
Figure 11B:
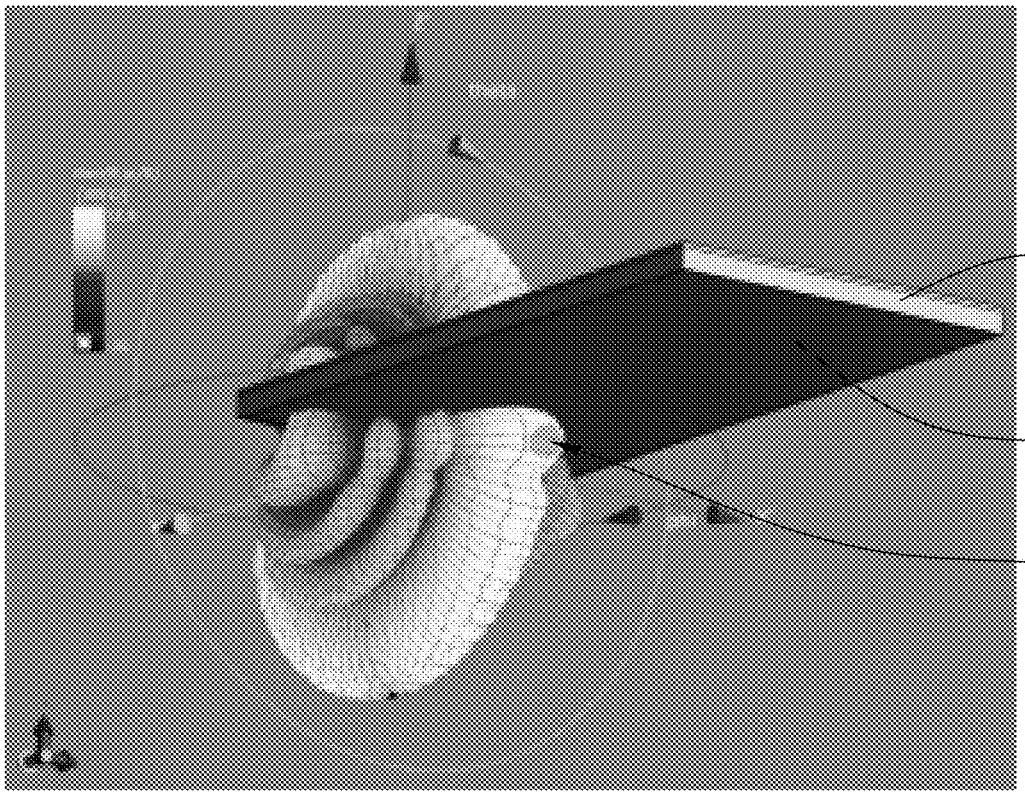
FIG. 11*b* is the radiation emulation view of the mobile terminal when the difference of second slot antenna units is 0°.
Figure 11C:
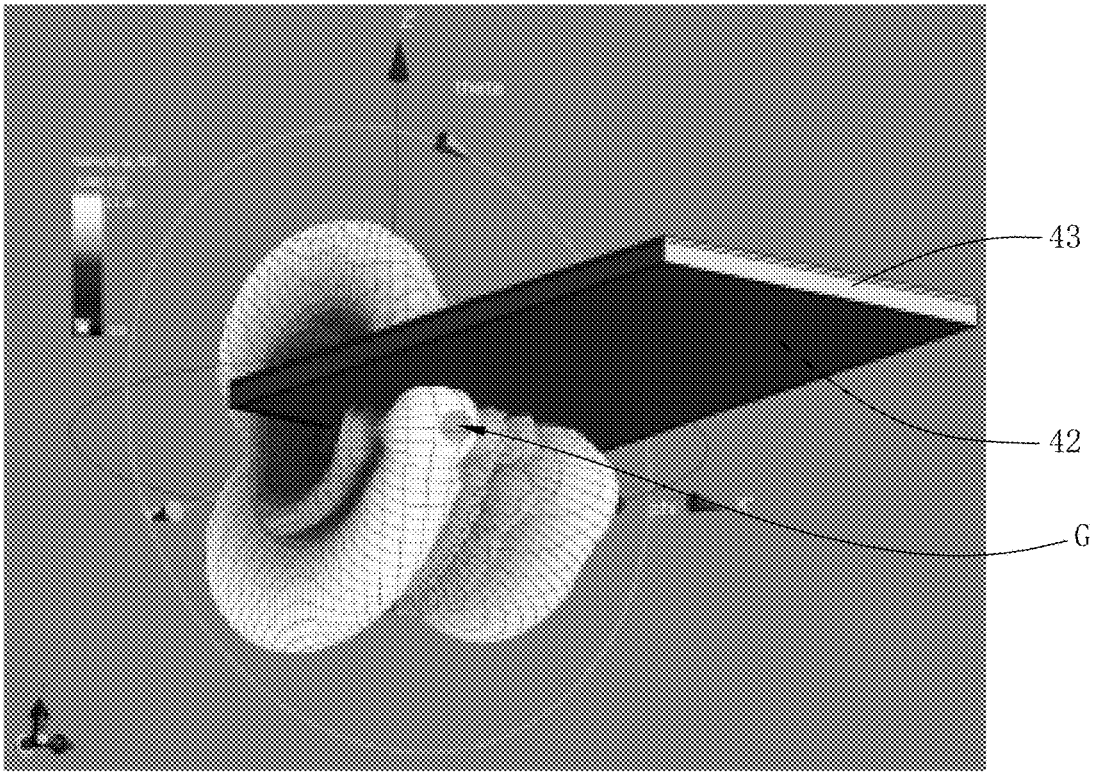
FIG. 11*c* is the radiation emulation view of the mobile terminal when the difference of second slot antenna units is 120°.

FIGS. 11*a*, 11*b* and 11*c* show beam pointed directions when the phase differences among the second slot antenna units 32 are respectively −120°, 0°, and 120°. Clearly indicated by the figures, with the different phase differences, the beams of the second slot antenna units 32 are scanned in the bottom area. The maximum gains G when the phase differences are −120°, 0° and 120° are respectively 10.7 dB, 12.9 dB, and 11.6 dB.

Figure 12A:
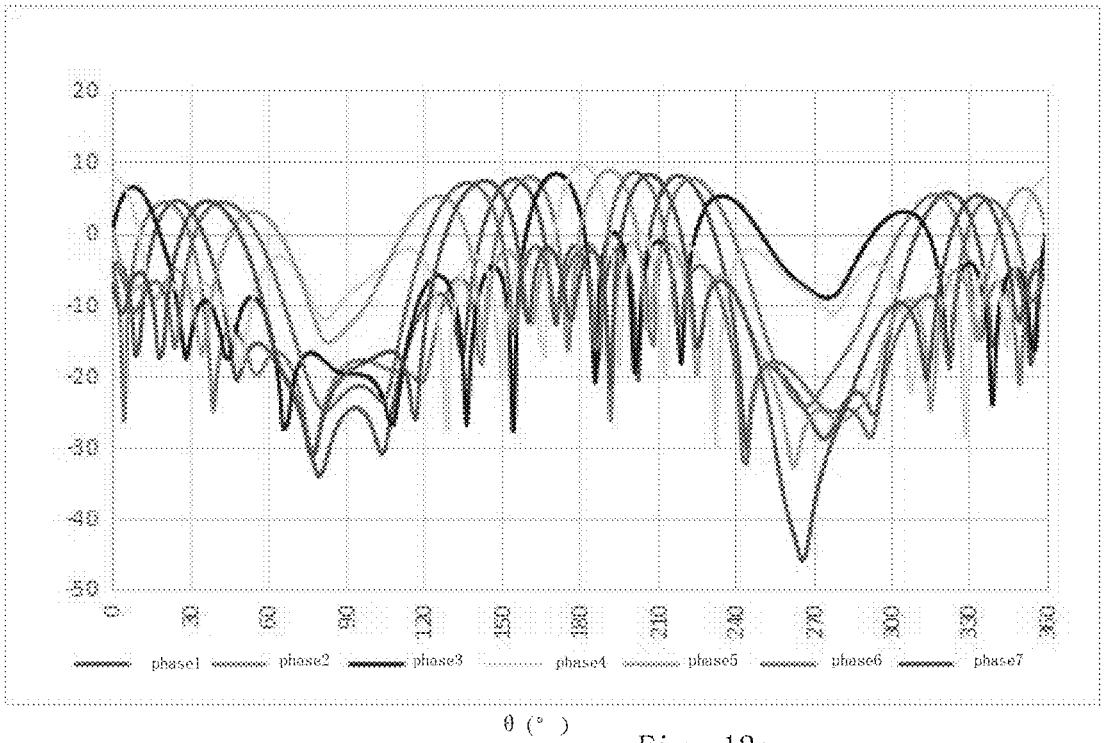
FIG. 12*a* is the emulation gain view of the bottom area, which is expressed in a rectangular coordinate way, of the mobile terminal.
Figure 12B:
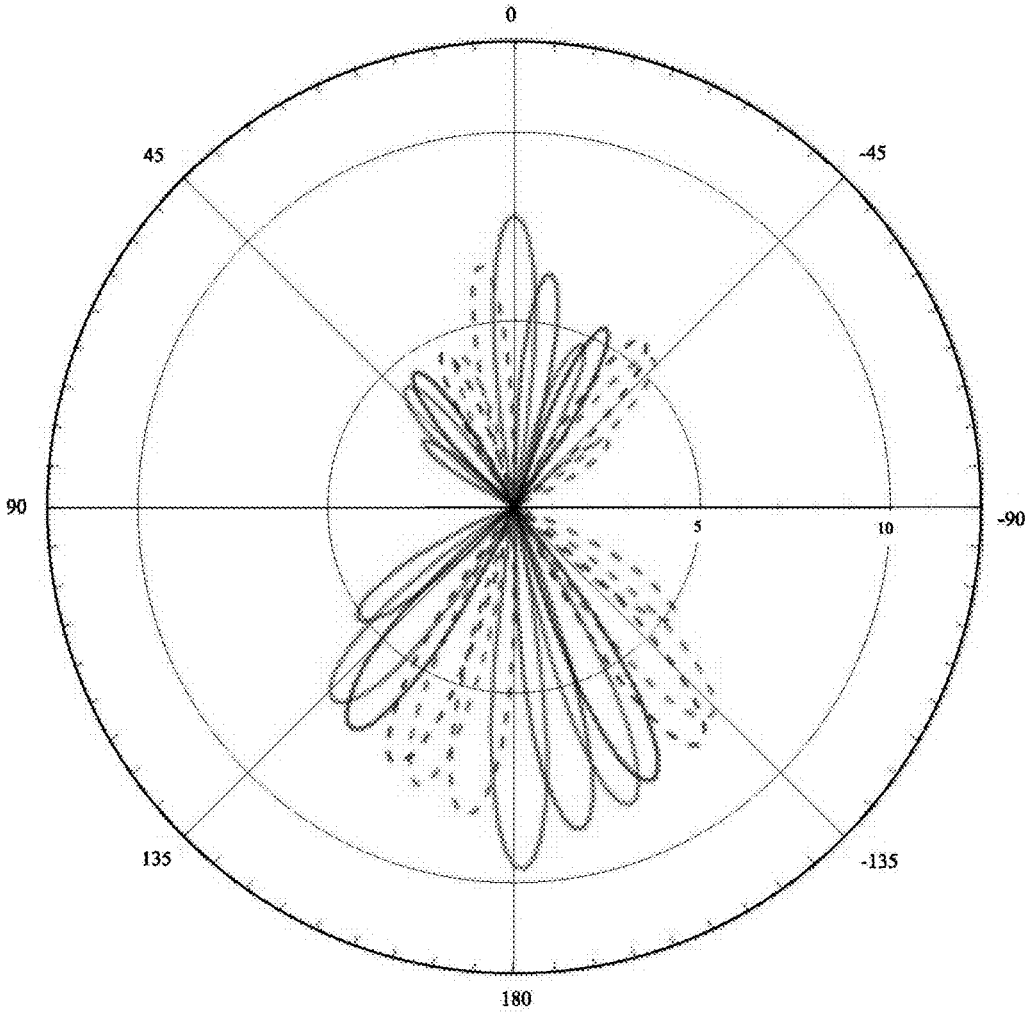
FIG. 12*b* is the emulation gain view of the bottom area, which is expressed in a polar coordinate way, of the mobile terminal.

FIGS. 12*a*-12*b* show the collection of the antenna gains of the second slot antenna units of the millimeter wave array antenna in seven different phase differences. Indicated by the antenna gain emulation, the scanning angle of the second millimeter wave array antenna is from 150° to 210°, and the total covering angle is 60°. The observation plane is the plane which is shown in FIG. 8.

Compared with the prior art, the millimeter wave array antenna and the mobile terminal of the invention have the following advantages: the millimeter wave array antenna is thin and can be vertically arranged on a side wall of the mobile terminal in order to occupy little horizontal space of the mobile terminal. The millimeter wave array antenna has low requirement on the clearance area and can be used if the antenna slot opening is not covered. The millimeter wave array antenna can scan the beams respectively in the two opposite directions of the mobile terminal.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A millimeter wave array antenna, comprising:

two metal grounding layers;

a sandwich metal layer between the two metal grounding layers, and comprising a top surface, a bottom surface and a plurality of antenna slots;

wherein, the top surface is connected with the two metal grounding layers along a long axis direction, the bottom surface is opposite to and in parallel with the top surface, the antenna slots space the array along the long axis direction, penetrate the top surface and bottom surface and are connected with the two metal grounding layers; and wherein the metal grounding layers are provided with feed parts at positions corresponding to each antenna slot, and, each of the antenna slots, the metal grounding layers and the sandwich metal layer forms a slot antenna unit.

2. The millimeter wave array antenna as described in claim 1, wherein the slot antenna unit comprises a plurality of first slot antenna units and a plurality of second slot antenna units, the feed parts of the first slot antenna units are arranged closely to the bottom surface, and the feed parts of the second slot antenna units are arranged closely to the top surface, the first slot antenna units form a first millimeter wave array antenna, and the second slot antenna units form a second millimeter wave array antenna; the first millimeter wave array antenna has main beams facing the top surface and the second millimeter wave array antenna has main beams facing the bottom surface.

3. The millimeter wave array antenna as described in claim 1, wherein the millimeter wave array antenna is a phased array antenna.

4. The millimeter wave array antenna as described in claim 1, wherein the millimeter wave array antenna comprises of a sandwich dielectric layer which is filled in the antenna slots and made from non-conductive materials.

5. The millimeter wave array antenna as described in claim 1, wherein the work frequency range of the millimeter wave array antenna includes 28 GHz.

6. The millimeter wave array antenna as described in claim 1, wherein a gap between the first slot antenna unit and the second slot antenna unit has a width half of the wavelength of a central work frequency point of the millimeter wave array antenna.

7. The millimeter wave array antenna as described in claim 1, wherein the millimeter wave array antenna is thinner than 1 mm along a direction from one metal grounding layer toward the other metal grounding layer.

8. A mobile terminal having the millimeter wave array antenna as described in claim 1, wherein the mobile terminal further comprises a back cover, a framework, and a frame between the back cover and the framework, the millimeter wave array antenna is arranged on an inner side surface of the frame, and the metal grounding layers of the millimeter wave array antenna are opposite to the inner side surface, the top surface of the sandwich metal layer faces the back cover, and the bottom surface of the sandwich metal layer faces the framework.

9. The mobile terminal as described in claim 8, wherein the metal back cover is provided with a first located groove at a position corresponding to the millimeter wave array antenna, and the metal framework is provided with a second located groove at a position corresponding to the millimeter wave array antenna.

10. The mobile terminal as described in claim 8, wherein main beams generated by the first millimeter wave array antenna point to the back cover, and main beams generated by the second millimeter wave array antenna point to the framework, the first millimeter wave array antenna and the second millimeter wave array antenna are phased array antennas.

* * * * *